US005526533A

United States Patent [19]

Plemmons, Sr.

[11] Patent Number: 5,526,533

[45] Date of Patent: Jun. 18, 1996

[54] HUNTING SUIT HAVING AN ATTACHED INTERIOR VEST

[76] Inventor: Ronald J. Plemmons, Sr., 1600 Granite St., Winston-Salem, N.C. 27107

[21] Appl. No.: 197,332

[22] Filed: Feb. 16, 1994

[51] Int. Cl.[6] ..... A41D 1/06

[52] U.S. Cl. ..... 2/79; 2/69; 2/80

[58] Field of Search ..... 2/79, 69, 69.5, 2/70, 75, 80, 93, 94, 95, 82

[56] References Cited

U.S. PATENT DOCUMENTS

| | | | |
|---|---|---|---|
| Re. 34,662 | 7/1994 | Keller | 2/79 |
| 1,670,213 | 5/1928 | Robichon | 2/79 |
| 1,915,597 | 6/1933 | Ducker | 2/95 |
| 2,478,765 | 8/1949 | Kim | 2/82 |
| 2,651,781 | 9/1953 | Buckholz | 2/69.5 |
| 3,837,006 | 9/1974 | Laseman | 2/69.5 |
| 4,507,805 | 4/1985 | Calutoiu | 2/69.5 |
| 5,081,718 | 1/1992 | Carman et al. | 2/79 |
| 5,267,352 | 12/1993 | Rodarmel | 2/95 |

FOREIGN PATENT DOCUMENTS

| | | | |
|---|---|---|---|
| 980816 | 5/1951 | France | 2/79 |
| 61961 | 1/1940 | Norway | 2/69 |
| 285760 | 2/1928 | United Kingdom | 2/79 |
| 462185 | 3/1937 | United Kingdom | 2/79 |

*Primary Examiner*—C. D. Crowder
*Assistant Examiner*—Gloria Hale

[57] ABSTRACT

A hunting suit is provided that is armless and that includes an interior vest sewn or otherwise attached to the inside rear surface of the hunting suit. During activities such as bow shooting, the wearer can easily unzip the upper front portion and allow the hunting suit to fall from the wearer out of the way while being retained by the vest. After shooting has terminated, the suit can easily be pulled over the shoulders and rezipped for maximum warmth and comfort. The hunting suit includes relatively short legs, which terminate with sewn-in boot portions.

12 Claims, 3 Drawing Sheets

HUNTING SUIT HAVING AN ATTACHED INTERIOR VEST

BACKGROUND OF THE INVENTION

1. Field of the Invention

The invention herein pertains to outdoor apparel and particularly to suits used for hunting and for other long periods of outdoor inactivity during cold and inclement weather conditions.

2. Description of the Prior Art and Objectives of the Invention

Insulated and other types of hunting suits, ponchos, jackets, coats and other clothing have been worn by hunters, sportsmen, skiers and the like for many years. During many outdoor activities, particular hunting, the wearers of such apparel oftentimes remain motionless, such as during deer hunting, for extended periods of time, whereby extreme discomfort is felt during bitterly cold temperatures. The arms, hands and fingers are particularly vulnerable and yet the hands and arms must maintain full dexterity, such as for shooting a bow or rifle. If the fingers, hands and arms become only slightly numb, a bow or rifle can be misaimed and all shooting accuracy will be lost. While conventional thick, heavy garments can oftentimes provide the necessary warmth, when the shooting activity begins, such garments are often difficult to maneuver in and, if removed, can become wet or snow covered making further use difficult and unpleasant.

Thus, with the known difficulties and disadvantages of conventional hunting garments, the present invention was conceived and one of its objectives is to provide a hunting suit that can be easily, partially removed and replaced on the wearer's body as needed.

It is still another objective of the present invention to provide a hunting suit that includes an upper trunk portion which is easily zipped closed from inside.

It is still another objective of the present invention to provide a hunting suit that includes a vest or other means for attachment to the wearer's body.

It is also an objective of the present invention to provide a hunting suit that has an attached boot portion.

It is yet another objective of the present invention to provide a hunting suit that can be easily removed and suspended from the wearer while shooting and, when shooting terminates, can be quickly replaced over the shoulders and closed to maintain maximum body warmth.

Various other objectives and advantages of the present invention become apparent to those skilled in the art as a more detailed description is set forth below.

SUMMARY OF THE INVENTION

The aforesaid and other objectives are realized by providing a hunting suit that includes an upper trunk portion, legs attached to the upper portion and boot portions affixed at the terminal ends of said leg. The upper trunk portion has a zipper having an interior zipper pull. The upper trunk portion is armless. A means for attaching the suit to the wearer's body, such as a vest, is affixed, such as by sewing, to the internal surface of the hunting suit. This design allows the wearer to unzip the suit, which allows the upper trunk portion to fall away, commence shooting and, after shooting, pull the hunting suit back over the wearer's shoulders and rezip the vest to maintain maximum body heat. As the suit is "armless," only one aperture, for the neck, is provided to help minimize heat loss.

BRIEF DESCRIPTION OF THE DRAWINGS

FIG. 4 depicts the hunting suit shown with the upper trunk unzipped to allow for shooting a bow or the like.

DESCRIPTION OF THE PREFERRED EMBODIMENT

The preferred form of the invention is shown in FIGS. 1–4 and includes a hunting suit having an upper trunk portion, lower legs and boot portions affixed at the terminal ends of the legs. When closed around the wearer, by a zipper, a single interior cavity is provided from the toes to the neck of the wearer, which allows maximum comfort as body heat is retained therein to provide warmth for the fingers, hands and arms. A vest is attached at its back to the rear internal surface of the hunting suit and a zipper having an internal pull on the trunk portion encloses the suit around the wearer. Leg portions extend only about one-third of the length of the hunting suit to increase the trunk portion capacity and interior space for better encapsulation and heat usage maximization. The zipper pull is located interiorly of the hunting suit, whereby the wearer can rapidly unzip the suit and manipulate a bow or other item without placing the suit or a portion thereof on the ground where it may become wet, snow covered or the like. After shooting ceases, the wearer can easily pull the suit back around his shoulders and rezip it from the inside where it again maximizes the body heat and provides comfort to the wearer.

DETAILED DESCRIPTION OF THE DRAWINGS AND OPERATION OF THE INVENTION

Figure 2:
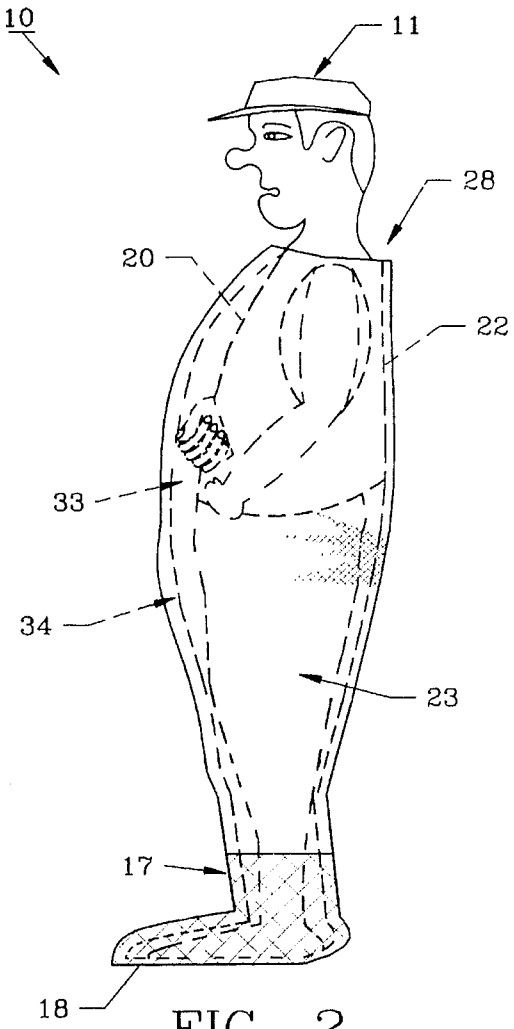
FIG. 2 shows a side elevational view of the hunting suit as worn in FIG. 1.
Figure 1:
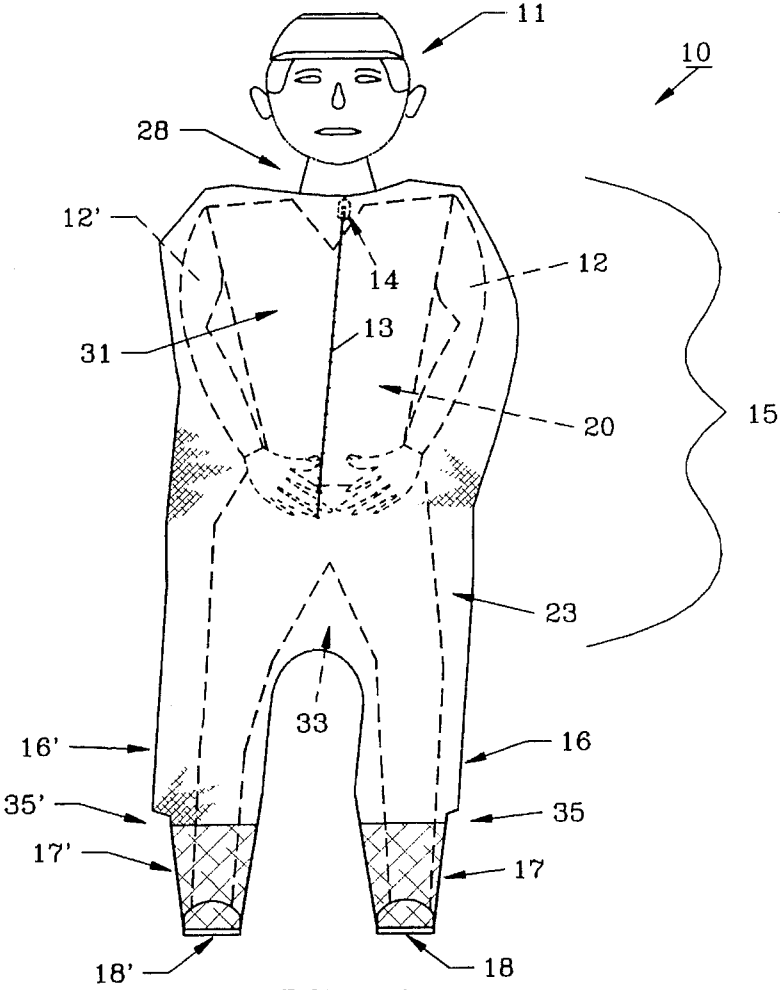
FIG. 1 illustrates the hunting suit of the invention as worn by an adult male with his arms contained therein and the suit zipped closed.
Figure 5:
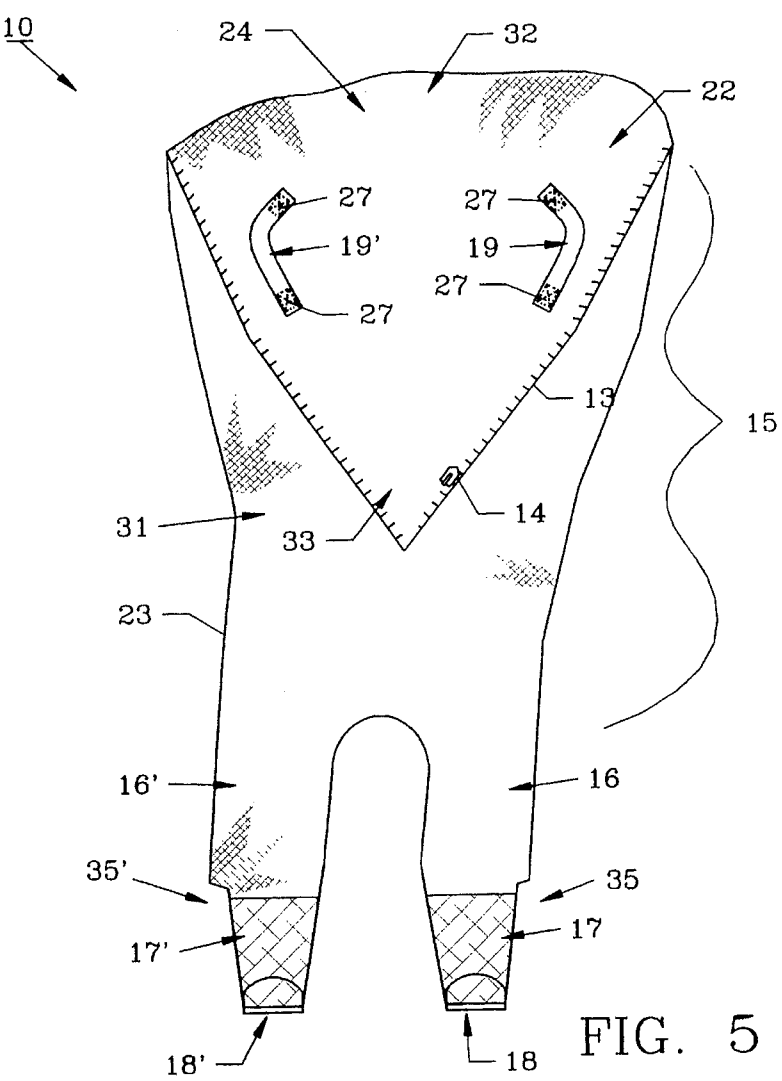
FIG. 5 pictures yet another embodiment of the hunting suit having straps rather than a vest.
Figure 3:
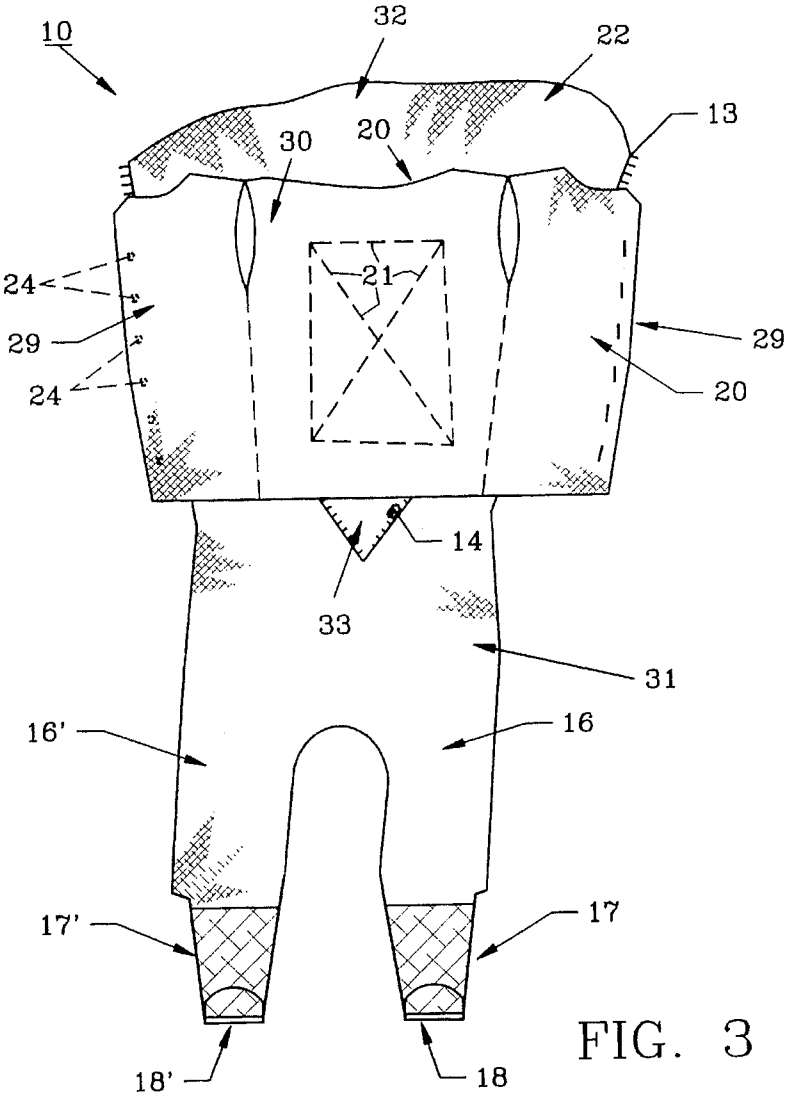
FIG. 3 demonstrates a front view of the hunting suit, such as shown in FIG. 1, not worn and with the vest opened fully.
Figure 4:
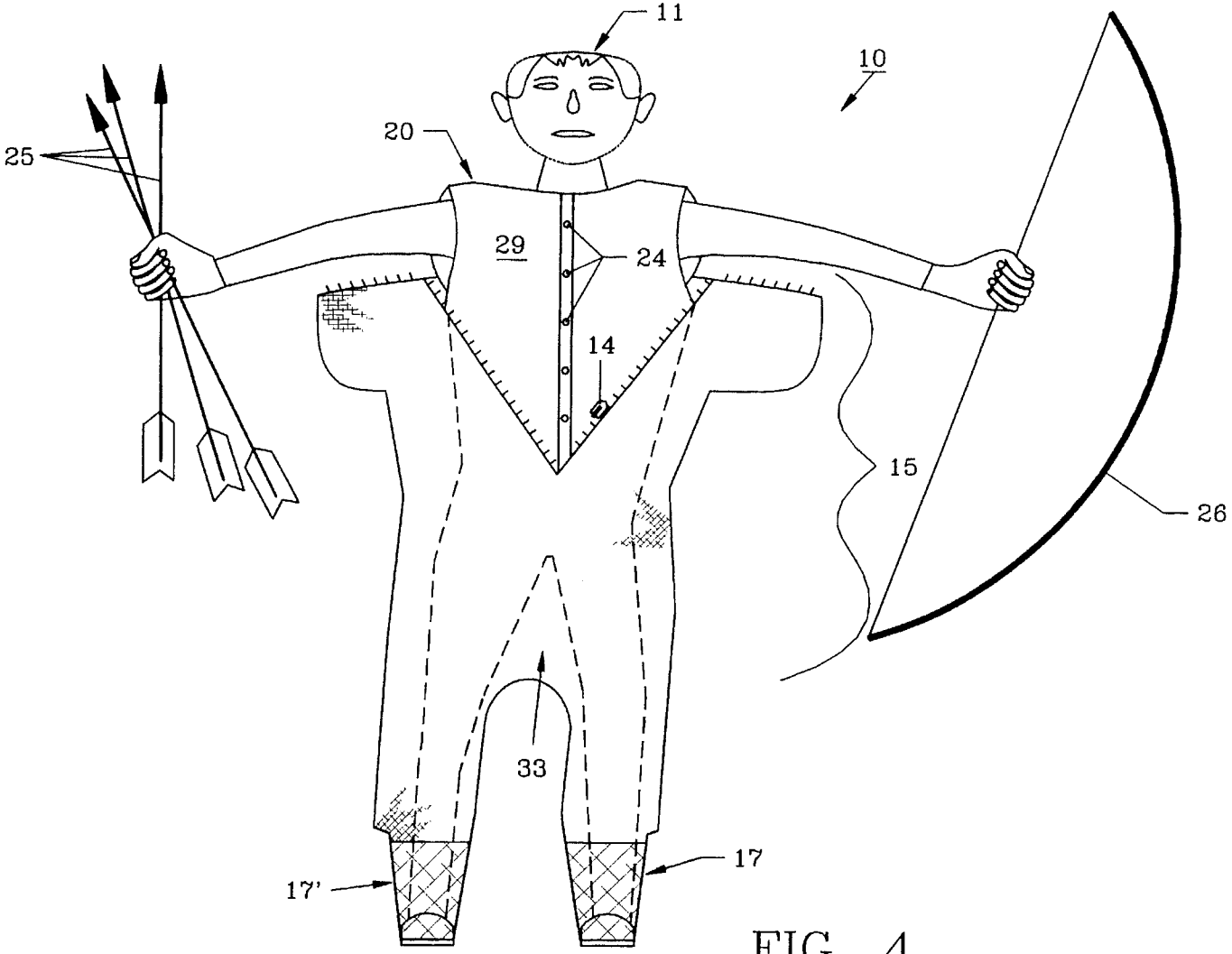

For a better understanding of the invention, turning now to the drawings, FIG. 1 illustrates hunting suit 10, which is armless, with wearer 11 therein. "Armless," as used herein means that hunting suit 10 has neither sleeves nor armholes. Wearer 11 is a typical adult male who may be, for example, bow hunting and utilizing hunting suit 10 to maintain warmth and comfort during extended periods of outdoor inactivity. As shown, wearer's arms 12, 12' are maintained inside of hunting suit 10, which is closed by zipper 13 that includes an interiorly located zipper pull 14, as also seen in FIG. 4, on front section 31 of hunting suit 10. Thus, when zipper 13 is closed, the only opening in hunting suit 10 is neck opening 28. Hunting suit 10 is formed from a suitable fabric to withstand outdoor weather and activities and may have a camouflage appearance on outer surface 23, as used by deer hunters and the like. Hunting suit 10 has an upper trunk portion 15 with lower legs 16, 16' attached thereto as shown in FIGS. 1 and 5. As can be seen in FIGS. 1 and 3–5, legs 16, 16' extend approximately one-third the overall length of hunting suit 10. While one would normally expect the legs of a suit to extend approxiately one-half the length of the suit, legs 16, 16' are shorter than normal to create a more voluminous single interior space 33, which keeps a wearer's legs warmer than would full-length suit legs in much the same way that a mitten, with its large single interior space, keeps a hand warmer than would a glove. At terminal ends 35, 35' of legs 16, 16' are boot portions 17, 17', which may comprise a double layer of quilted fabric or the like and include soles 18, 18'. Boots, shoes or socks may be worn inside of boot portions 17, 17' depending on the particular desires of the wearer.

Vest 20 acts as a means interior of hunting suit 10 to attach suit 10 to the wearer and which has front 29 and back 30 (FIG. 3) and is shown with hidden lines in FIG. 1. Vest 20 allows the wearer to only partially remove hunting suit 10 during shooting. As shown in FIG. 3, vest 20 is attached at vest back 30, such as by sewing along lines 21, to internal surface 22 of rear section 32 (rear internal surface) of hunting suit 10. Sewing lines 21 extend over the majority of vest back 30 to prevent movement of vest 20 relative to upper portion 15. Vest front 29 has fasteners, such as buttons 24, to hold vest securely on wearer 11. As vest 20 is attached to internal surface 22 of hunting suit 10, wearer 11 can maintain warmth during periods of outdoor inactivity and cold weather and, upon spotting game, can easily unzip the upper trunk portion 15 of hunting suit 10 and can shoot a bow, rifle or the like without totally removing hunting suit 10. Thus, hunting suit 10 will simply hang out of the way, suspended behind wearer 11, as shown in FIG. 4, and when the shooting activity has terminated, wearer 11 can again zip hunting suit 10 closed from within, with the arms contained and maintain body warmth. As shown in FIG. 4, wearer 11 can hold arrows 25 and bow 26 easily with hunting suit 10 unzipped and could manipulate a rifle or other item without interference from hunting suit 10 as it is suspended from vest back 30.

As shown in FIGS. 1–4, vest 20 provides a means for securely attaching hunting suit 10 to the body of wearer 11. FIG. 5 depicts another embodiment of the invention with straps 19, 19' used in place of vest 20 to attach hunting suit 10 to a wearer. Straps 19, 19' can be positioned over a wearer's shoulders, much like backpack straps are worn, to hold hunting suit 10 to a wearer's body. Straps 19, 19' are joined to internal surface 22 of rear section 32 by, for example, stitches 27. However, it should be understood that various other means of attaching hunting suit 10, such as belts, loops, harnesses or the like, affixed to internal surface 22 would also allow hunting suit 10 to be utilized in the same manner. It should also be understood that the means for attaching hunting suit 10 may have adjustment and fastening mechanisms, such as buckles, resilient components, hook-and-loop fasteners, and the like, to ensure a good fit and optimal comfort for the wearer.

Hunting suit 10 may be formed with a hood (not shown) if desired, and may include outside pockets or belt loops and, of course, could be formed of a conventional "thermal" insulating material 34. Another embodiment of hunting suit 20 may eliminate boot portions 17, 17'. A collar and/or a hood may be affixed and the inside of hunting suit 10 may be lined for severe weather hunting as needed.

The illustrations and examples provided herein are for explanatory purposes and are not intended to limit the scope of the appended claims.

I claim:

1. A hunting garment comprising: an upper portion, said upper portion having internal and external surfaces, said upper portion also having front and rear sections, a vest, said vest defining arm holes, said vest comprising a back surface, said back surface having an upper edge, said back surface joined to said internal surface of said upper portion substantially below said upper edge proximate said arm holes to allow said upper portion to be partially removed from a wearer and be suspended below said arm holes of said vest.

2. The hunting garment of claim 1 wherein said vest is joined to said internal surface of said upper portion by a plurality of stitches.

3. The hunting garment of claim 1 wherein said upper portion is armless.

4. The hunting garment of claim 1 wherein said hunting garment is formed from an insulating material.

5. The hunting garment of claim 1 wherein said legs extend approximately one-third the overall length of said hunting garment.

6. The hunting suit of claim 1 and including legs, said legs joined to said upper portion.

7. An armless insulated hunting suit comprising:

(a) a pair of legs;

(b) an upper portion, said pair of legs attached to said upper portion, said upper portion comprising internal and external surfaces, said upper portion also comprising front and rear sections;

(c) a vest, said vest for attaching said upper portion to a wearer, said vest joined to said internal surface of said rear section of said upper portion, whereby said vest supports said hunting suit on said wearer and allows said hunting suit to be partially removed and suspended from said vest.

8. The armless hunting suit of claim 7 wherein said vest includes a back, said back sewn to said internal surface of said upper portion at said rear section.

9. The armless hunting suit of claim 7 wherein said pair of legs comprise boot portions.

10. The armless hunting suit of claim 7 wherein said legs extend one-third the overall length of said armless hunting suit.

11. The armless hunting suit of claim 7 wherein said front section comprises two halves, said halves fastened together by a vertical zipper, said zipper comprising a zipper pull, said zipper pull positioned interiorly, whereby said wearer can operate said zipper interiorly of said armless hunting suit.

12. An armless hunting suit comprising: a pair of legs, an upper portion, said upper portion attached to said pair of legs, said upper portion having internal and external surfaces, said upper portion being continuous without arms and without arm receiving apertures, and means to attach said armless hunting suit to a wearer, said attachment means connected to said internal surface of said upper portion to allow said armless hunting suit to be partially removed from said wearer and suspended from said attachment means.

* * * * *